United States Patent [19]

Larson

[11] 3,989,972

[45] Nov. 2, 1976

[54] HIGH PRESSURE MERCURY VAPOR DISCHARGE LAMP CONTAINING BISMUTH IODIDE

[75] Inventor: Daniel A. Larson, Cedar Grove, N.J.

[73] Assignee: Westinghouse Electric Corporation, Pittsburgh, Pa.

[22] Filed: Oct. 27, 1967

[21] Appl. No.: 678,664

[52] U.S. Cl. ..... 313/229; 313/184

[51] Int. Cl.[2] ..... H01J 61/20

[58] Field of Search ..... 313/184, 225, 227, 228, 313/229

[56] References Cited

UNITED STATES PATENTS

| | | | |
|---|---|---|---|
| 2,765,416 | 10/1956 | Beese et al. | 313/223 X |
| 3,234,421 | 2/1966 | Reiling | 313/229 X |
| 3,262,012 | 7/1966 | Koury et al. | 313/227 X |
| 3,331,982 | 7/1967 | Waymouth et al. | 313/225 |
| 3,416,023 | 12/1968 | Eckel et al. | 313/229 X |
| 3,450,925 | 6/1969 | Johnson | 313/227 X |

OTHER PUBLICATIONS

"Characteristics of Mercury Vapor–Metallic Iodide Arc Lamps," by Gilbert H. Reiling, Journal of the Optical Society of America, vol. 54, No. 4, pp. 532–540, Apr. 1964.

"Tubular Metal Halide Arc Lamps for Photoreproduction Applicatons," by R. D. Ayotte and R. R. Hale, Transaction I. E. S., pp. 221–228, Apr. 1967.

*Primary Examiner*—Palmer C. Demeo

*Attorney, Agent, or Firm*—B. R. Studebaker

[57] ABSTRACT

A high pressure, mercury-vapor (HPMV) discharge lamp of the additive type having a discharge sustaining filling which includes between 0.5 and 2.5 mg. of bismuth iodide ($BiI_3$) per cubic centimeter of arc tube volume, a mercury charge of about 3.0 mg. per cubic centimeter of arc tube volume and a small quantity of inert ionizable starting gas whereby a substantially continuous radiation spectrum is achieved.

1 Claim, 2 Drawing Figures

WITNESSES:
Bernard R. Giegner
Leon M. Garman

INVENTOR
Daniel A. Larson
BY
Blair R. Studebaker
ATTORNEY

HIGH PRESSURE MERCURY VAPOR DISCHARGE LAMP CONTAINING BISMUTH IODIDE

BACKGROUND OF THE INVENTION

This invention relates to discharge devices and more particularly to a high pressure, mercury-vapor, discharge lamp of the additive type wherein an additive metal iodide is utilized to supplement the usual mercury discharge.

High pressure, mercury vapor, discharge lamps (HPMV lamps) are well known and have been used extensively for highway and industrial lighting purposes, as well as numerous other applications. Although the color emitted by the mercury lamp is not entirely displeasing, the color rendition of illuminated objects leaves something to be desired in that the visible spectral radiations emitted are concentrated primarily in the green and yellow. In the non-additive mercury vapor lamp there is a distinct lack of radiation in the blue green region and also in the orange and red spectral regions. Although these deficiencies have been corrected to a degree by phosphor coating of the outer bulb, problems in increased source size and the efficient utilization of light are thereby introduced.

Considerable effort has been expended to improve the color rendition provided by high pressure vapor arc lamps of the HPMV type. Particular emphasis has been placed upon the substitution of various metal vapors for mercury and on the use of metal and/or metal iodide additives in conventional mercury-vapor lamps. Although color rendition has in many cases been improved by these efforts other problems of even greater moment have been introduced. For example, many of the metal substitutes such as cadmium and zinc are difficult to vaporize, and sodium metal, which provides comparatively good color rendition at high temperatures, is less difficult to vaporize but cannot be used with quartz of temperatures above 300° C due to a severe reaction with the quartz. Many of the additive type lamps introduce still different problems, for example, some iodides, such as sodium iodide, have a tendency to react with the arc tube and possibly with other arc tube parts during operation. This reaction releases free iodine which in turn increases the voltage required to initiate the discharge and attacks other parts within the arc tube which reduces the lamp life considerably.

SUMMARY OF THE INVENTION

It is an object of the present invention to provide a high pressure gas discharge lamp of the additive type which produces improved color rendition of illuminated objects as compared with a conventional HPMV lamp.

Another object of the present invention is to provide a high pressure gas discharge lamp of the additive type which generates a substantially continuous spectrum of visible light.

The foregoing as well as other objects of the present invention will become more readily apparent as the description proceeds, and are achieved by providing a discharge sustaining filling in an additive type discharge lamp which includes predetermined amounts of mercury and bismuth iodide along with a small amount of inert ionizable starting gas in an arc tube of predetermined volume. More particularly, the predetermined amount of mercury is about 3.0 mg. per cubic centimeter of arc tube volume and during normal operation of the lamp will provide a predetermined mercury vapor pressure within said arc tube. The bismuth iodide, is present in an amount of about 0.5 to 2.5 mg. per cubic centimeter of arc tube volume and when substantially vaporized during operation of the lamp will produce in conjunction with the mercury a radiation spectrum which is substantially continuous.

BRIEF DESCRIPTION OF THE DRAWING

The foregoing objects and others along with many of the attendant advantages of the present invention will become more readily apparent and better understood as the following detailed description is considered in connection with the accompanying drawing, in which.

DESCRIPTION OF THE PREFERRED EMBODIMENT

Figure 1:
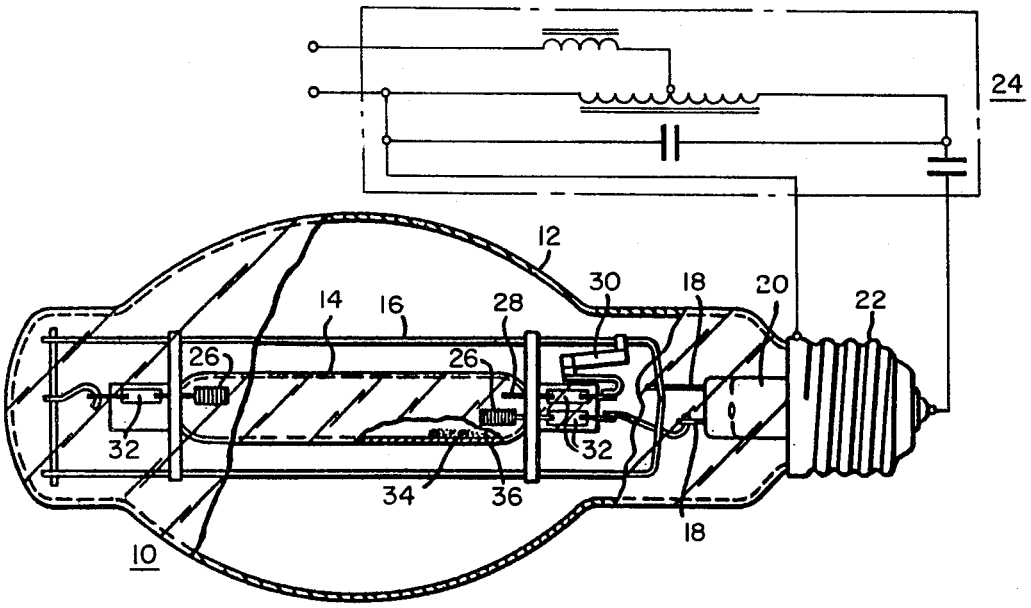
FIG. 1 is a side elevation of an HPMV lamp of the present invention with a portion of the outer bulb broken away and connected to a conventional energizing power source.

The specific form of the invention illustrated in the drawing is generally similar in construction to the usual high pressure mercury vapor (HPMV) lamp, such as that described in U.S. Pat. No. 2,748,303 dated May 29, 1956 to Thorington. The lamp, generally designated 10, includes a radiation transmitting sealed outer envelope 12 spaced from and surrounding an inner envelope or arc tube 14. The inner envelope 14 is conventionally mounted within outer envelope 12 by means of a supporting frame 16 carried by one of two lead-in conductors 18, each of which is sealed through the outer envelope 12 by a conventional reentrant stem press 20 connected to a standard mogel base 22. The mogel base 22 facilitates electrical connection to a power source 24 in the well known manner.

Sealed within the inner envelope 14 and disposed at opposite ends thereof are a pair of tungsten operating electrodes 26. Adjacent one of the operating electrodes 26 is a tungsten starting electrode 28. Each of the electrodes 26, 26, 28 are electrically connected to lead-in conductors 18. A starting resistor 30 is connected between the starting electrode 28 and one of the lead-in conductors 22. Lead-in conductors 32 are employed to facilitate hermetically sealing of the electrodes 26, 26 and 28 through the ends of the inner envelope 14.

Within inner envelope or arc tube 14 is disposed a predetermined amount of mercury 34. The mercury charge is preferably about 3.0 mg. per cubic centimeter of arc tube of volume. A small charge of inert ionizable starting gas such as for example argon is also disposed within the arc tube 14 to facilitate starting. The charge of mercury is such that when the mercury is fully vaporized during operation of the lamp, the proper voltage drop across the lamp and the proper power input to the lamp will be realized. In addition to the predetermined amount of mercury and the inert ionizable starting gas there is also disposed within the arc tube 14 a predetermined amount of bismuth iodide 36. The bismuth iodide ($BiI_3$) is preferably in an amount from between about 0.5 to 2.5 mg. per cubic centimeter of arc tube volume.

As a specific example, the arc tube 14 of the type normally used in a 400 watt lamp will have an outside diameter of 22 mm. and enclose a volume of about 22 cubic centimeters. When this arc tube is charged with argon as the inert ionizable starting gas at a pressure of about 25 mm. of Hg., about 66 mg. of mercury and about 50 mg. of bismuth iodide and operated at 500 watts, 2.8 amps, and with a voltage drop of about 200 volts the output will be substantially that shown in the spectral emission diagram of FIG. 2. The color rendition of this lamp is extremely good and as will be noted from FIG. 2 a strong background continual in the visible area of the spectrum is produced along with mercury lines at 3650 and 4358 and bismuth atomic lines at 4122 and 4723.

Figure 2:
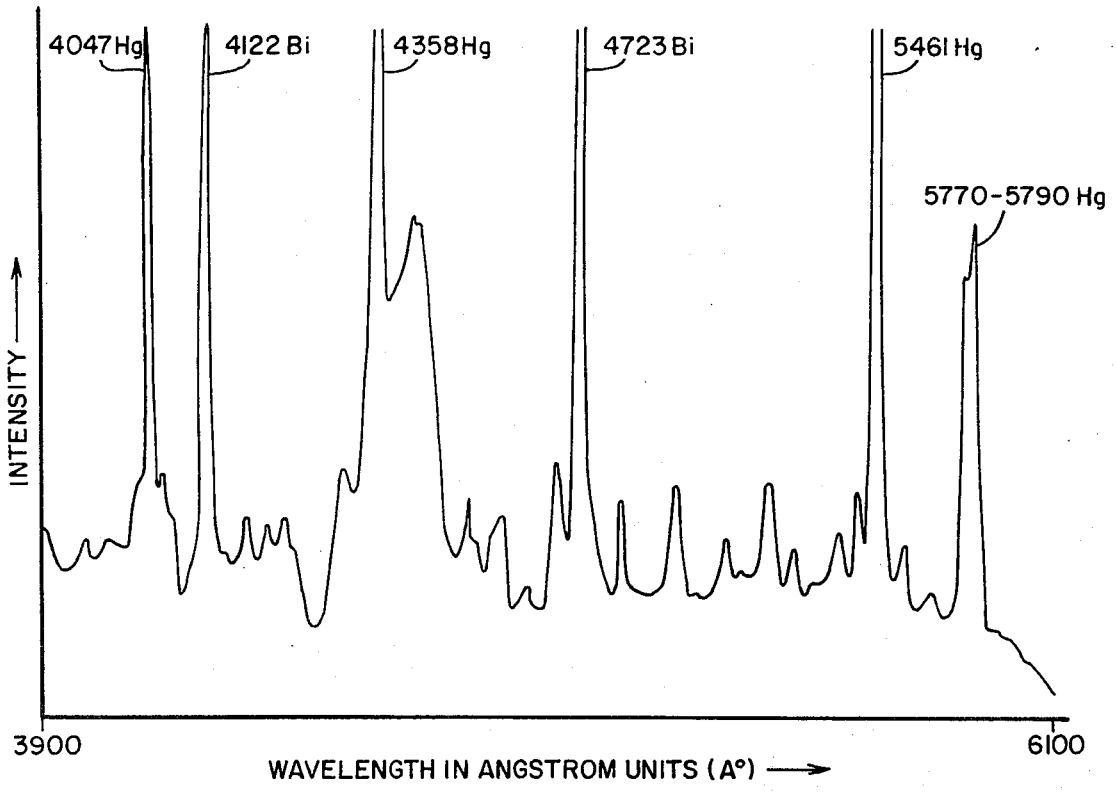
FIG. 2 is a spectral distribution diagram of a typical lamp constructed in accordance with the present invention.

Another example of a lamp which produced a radiation spectrum similar to that shown in FIG. 2 employed an arc tube 14 having a volume of 11.4 cubic centimeters and was charged with argon at a pressure of 25 mm., 32 mg. of mercury and 5 mg. of bismuth iodide. This lamp operating at 400 watts evidenced a voltage drop of 113 volts at 3.85 amps and produced 11,300 lumens. The same lamp operated at 500 watts evidenced a voltage drop of 116 volts at 4.7 amps and produced 15,000 lumens. Again, the bismuth iodide additive (HPMV) lamp produced extremely good color rendition.

In operation, the lamp 10 is initially started by the establishment of a discharge between the tungsten starting electrode 28 and the adjacent operating electrode 26 through the argon or other starting gas. A straight tungsten wire is employed for the starting electrode to minimize any reaction between the starting electrode and the bismuth iodide which can produce a black deposit on the walls of the inner envelope 14. Thereafter a discharge will be established between the two operating electrodes 26 which will heat all the mercury charge 34 to a fully vaporized condition. As the mercury becomes fully vaporized, the operating temperature of the arc tube 14 will increase to a point at which the coolest point on the inner wall of the arc tube is in excess of 600° C, at which time a substantial portion of the bismuth iodide will be vaporized. When a substantial portion of the bismuth iodide is vaporized the discharge assumes the characteristics of a bismuth iodide discharge with its attendant continuous spectrum from the blue into the infra-red. As will be apparent from the foregoing the extremely good color rendition obtained by the lamp of the present invention can be produced in a conventional arc tube when charged initially with a small quantity of inert ionizable starting gas such as for example argon, about 3.0 mg. per cubic centimeter of arc tube volume of mercury and from about 0.5 to 2.5 mg. per cubic centimeter of arc tube volume of bismuth iodide.

Since numerous changes may be made in the above-described invention and different embodiments thereof may be made without departing from the spirit thereof, it is intended that all matter contained in the foregoing description or shown in the accompanying drawings, shall be interpreted as illustrative and not in a limiting sense.

I claim as my invention:

1. A vapor arc photochemically useful light source comprising:

a. an ultra-violet light transmissive evacuable envelope b. a pair of arc-electrodes disposed within said envelope and defining therebetween an arc path, c. a filler within said envelope comprising 1. a quantity of mercury sufficient upon volatilization thereof to establish within said envelope a pressure of mercury vapor sufficient to sustain an arc dicharge between said electrode and raise the inner wall of said envelope to operating temperature 2. a quantity of a halide of bismuth (other than the fluoride) sufficient at lamp operating temperature to produce a partial pressure of bismuth halide sufficient to dissociate in said arc and radiate photochemically useful radiation characteristic of the bismuth atom 3. a quantity of a starting gas sufficient to ionize upon application of operating voltages to said lamp and vaporize said mercury, 4. said quantity of mercury being sufficient to cause collision line-broadening of the emission of said bismuth atom, but insufficient to cause depletion of bismuth halide.

* * * * *